US011713607B2

(12) United States Patent
Fontijn et al.

(10) Patent No.: US 11,713,607 B2
(45) Date of Patent: Aug. 1, 2023

(54) ROLLER CENTERING DEVICE FOR CENTERING A SLIDING DOOR OR WINDOW

(71) Applicant: GOLDBRECHT LLC, Culver City, CA (US)

(72) Inventors: Marcel Fontijn, Culver City, CA (US); Thomas Kern, Culver City, CA (US)

(73) Assignee: GOLDBRECHT LLC, Culver City, CA (US)

( * ) Notice: Subject to any disclaimer, the term of this patent is extended or adjusted under 35 U.S.C. 154(b) by 163 days.

(21) Appl. No.: 16/255,420

(22) Filed: Jan. 23, 2019

(65) Prior Publication Data

US 2019/0226257 A1 Jul. 25, 2019

Related U.S. Application Data

(60) Provisional application No. 62/620,632, filed on Jan. 23, 2018.

(51) Int. Cl.
*E05D 15/06* (2006.01)

(52) U.S. Cl.
CPC ..... *E05D 15/0665* (2013.01); *E05D 15/0656* (2013.01); *E05D 15/0691* (2013.01); *E05Y 2201/692* (2013.01); *E05Y 2800/412* (2013.01); *E05Y 2900/132* (2013.01); *E05Y 2900/148* (2013.01)

(58) Field of Classification Search
CPC ..... E05D 15/0652; E05D 15/0686; E05D 15/0656; E05D 15/0691; E05Y 2201/692; A47K 3/34
USPC ..... 16/100, 96 R; 49/411, 413
See application file for complete search history.

(56) References Cited

U.S. PATENT DOCUMENTS 115,333 A * 5/1871 Lyons
794,524 A * 7/1905 Lobel
1,274,872 A * 8/1918 Gordon ..... E05D 15/0686 49/372
1,399,616 A * 12/1921 Guerrant ..... B61D 19/005 16/96 R
2,061,279 A * 11/1936 Kurtzon ..... F16C 29/04 384/49
2,353,976 A * 7/1944 Thompson ..... B61D 19/005 16/96 R
2,479,839 A * 8/1949 Ives ..... E05D 15/0643 16/88

(Continued)

FOREIGN PATENT DOCUMENTS

DE 19954111 A1 * 5/2001 ..... E05D 15/0656
EP 2248978 A2 * 5/2010 ..... E05D 15/06

(Continued)

*Primary Examiner* — Marcus Menezes
(74) *Attorney, Agent, or Firm* — Sughrue Mion, PLLC

(57) ABSTRACT

A centering device for centering a sliding door or window, including a rail; a moving member configured to be movable along the rail; and a plurality of centering rollers fixed to one of the rail and the moving member and spaced along a length thereof corresponding to a direction of movement of the door or window along the rail, the centering rollers abutting against an other of the rail and the moving member to laterally center the moving member with respect to the rail. The centering device can be implemented in a sill, header and jamb.

4 Claims, 7 Drawing Sheets

(56) References Cited

U.S. PATENT DOCUMENTS

| | | | | | |
|---|---|---|---|---|---|
| 2,527,740 | A * | 10/1950 | Kurtzon | E05D 15/0678 | 16/88 |
| 2,920,581 | A * | 1/1960 | Cook | B65G 9/008 | 104/93 |
| 4,156,953 | A * | 6/1979 | Ten | | |
| 5,671,501 | A * | 9/1997 | Laramie | A47K 3/34 | 16/96 R |
| 8,806,808 | B2 * | 8/2014 | Joray | E06B 3/4609 | 49/425 |
| 10,072,449 | B2 * | 9/2018 | Jang | E05D 15/0665 | |
| 11,136,802 | B2 * | 10/2021 | Tsimbikos | E05D 15/0665 | |
| 2011/0197515 | A1 * | 8/2011 | Joray | E06B 3/4609 | 49/425 |
| 2012/0291392 | A1 * | 11/2012 | Joray | E05D 15/0682 | 52/656.5 |
| 2015/0354258 | A1 * | 12/2015 | Geysels | E04F 21/0023 | 49/425 |
| 2017/0138105 | A1 * | 5/2017 | Jang | F16C 19/32 | |
| 2019/0194991 | A1 * | 6/2019 | Fontijn | E06B 3/42 | |
| 2019/0383078 | A1 * | 12/2019 | Tsimbikos | E05D 15/0686 | |

FOREIGN PATENT DOCUMENTS

| | | | | |
|---|---|---|---|---|
| EP | 3425148 | A1 * | 1/2019 | E05D 15/0656 |
| FR | 3005092 | * | 10/2014 | E06B 3/46 |

* cited by examiner

ROLLER CENTERING DEVICE FOR CENTERING A SLIDING DOOR OR WINDOW

BACKGROUND

1. Field

Exemplary embodiments relate to sliding doors and windows, and more particularly, to an assembly allowing automatic adjustments of roller mechanisms to center a door or window in a frame to reduce friction, ensure smooth and proper movement of the door or window elements, and achieve optimal weather proofing.

2. Description of the Related Art

Conventional methods and apparatuses for moving windows and doors in a frame include sliding the window or door along a track. However, these conventional methods and apparatuses are subject to misalignment between the moving member of the door or window and the frame. For example, if the moving member is not properly centered in the frame, the moving member can contact the frame thereby creating frictional forces on the contact side and an excessive gap on the opposite side. These forces can increase the force necessary to move the door or window, in particular if the door or window is large or heavy. Further, continuous scraping of the moving member against the frame can damage the door or window and can cause misalignment of other portions of the door, thereby requiring various elements to be replaced or repaired and thereby reducing the life of the door or window. In addition, if an excessive gap is created on the opposite side from the contact side, it is impossible to achieve or maintain optimal compression of the weather sealing device that protects from water and air penetration.

Exemplary embodiments overcome these shortcomings and solve the problems associated with the prior methods and apparatuses for moving doors and windows. The exemplary embodiments provide a mechanism for centering the moving member of door and window frames to compensate for movement of the moving member in a direction other than the intended moving direction of the door or window.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

Figure 1D:
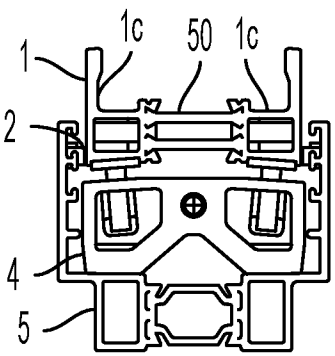
FIGS. 1A and 1B illustrate a roller centering device according to an exemplary embodiment and FIGS. 1C and 1D illustrate a modification thereof.
Figure 1C:
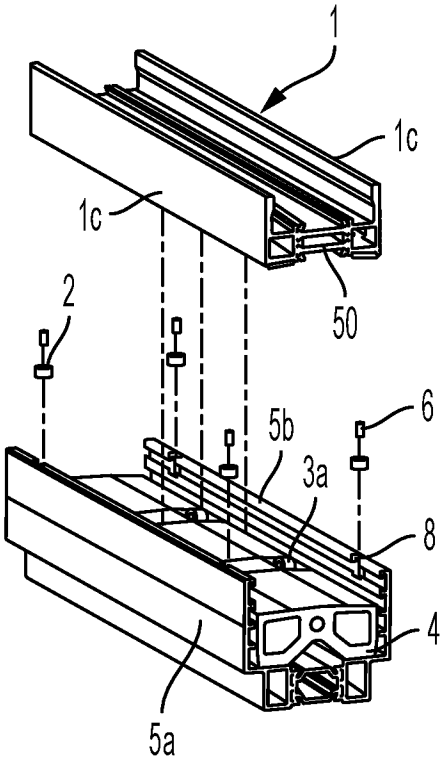
Figure 1B:
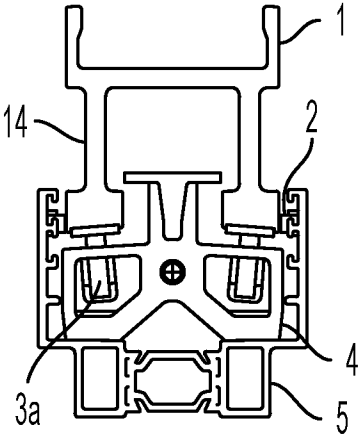
Figure 1A:
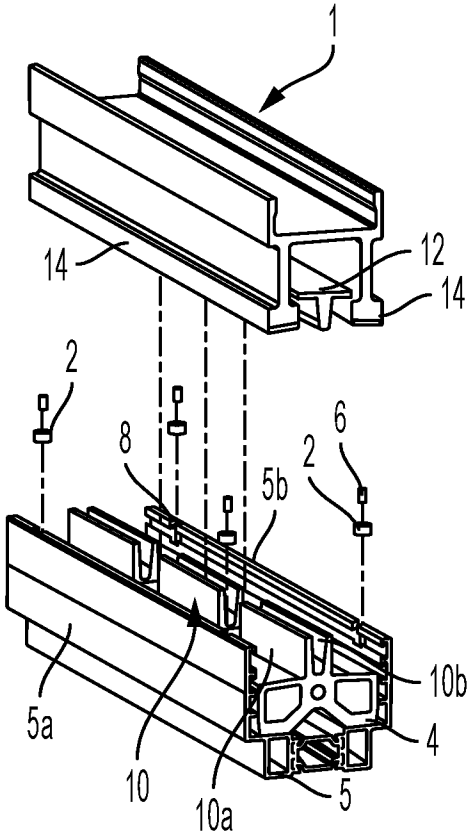

As shown in the drawings, with reference made to the reference numerals in FIGS. 1A and 1B, the roller centering device according to an exemplary embodiment includes a moving member 1 for moving a panel of a door or window (not shown) secured thereto and provided in a door or window frame 5. The moving member 1 rests atop a rail 4 provided in the frame 5. The rail 4 includes a bearing block 3 which houses roller bearings 3*a* for movably supporting the vertical load of the door or window. The moving member 1 moves within the frame 5 along the roller bearings 3*a*. In this exemplary embodiment, the roller centering device is provided in the sill of the door or window (lower track), but it should be understood that it could be provided in the header (upper track) or jamb (side track) of the door or window.

According to an exemplary embodiment shown in FIG. 1, the frame 5 includes a pair of side walls 5*a*, 5*b* on the left and right side of the frame 5, respectively. The side walls 5*a*, 5*b* each include at least one centering roller 2. The pair of side walls 5*a*, 5*b* each include at least one hole 8 in which the centering roller 2 is provided. A fixing member 6 is provided through a hole in the center of the centering roller 2 to fix the centering roller 2 to the frame 5 while permitting the centering roller to rotate. In the exemplary embodiment illustrated in FIGS. 1A and 1B, there are provided two centering rollers on each of the sidewalls 5*a* and 5*b* to allow for uniform centering of the moving member, and hence the door or window, within the rail. Additional centering rollers may be provided, as desired. As shown in FIGS. 1A and 1B, the moving member includes downwardly extending wings 14 that are contacted by the centering rollers along the outer surfaces of the wings and by the roller bearings 3*a* along the bottom surface of the wings 14.

While exemplary embodiments illustrate that the centering rollers 2 are provided in hole 8 formed in the respective sidewalls 5*a* and 5*b*, the exemplary embodiments are not limited thereto, and the centering rollers 2 may be provided in a slot or other opening provided in the frame 5 that allows the centering rollers 2 to contact and center the moving member 1 when moved. In exemplary embodiments, the centering rollers 2 rotate about an axis substantially perpendicular to the moving direction of the moving member 1. However, those of ordinary skill in the art will understand that the centering roller 2 is not limited to this configuration. According to other exemplary embodiments, the axis may be angled.

The exemplary embodiment of FIGS. 1C and 1D differ from that of FIGS. 1A and 1B in that the moving member 1 has a smaller profile by excluding the downwardly extending wings 14. Also, in this embodiment, the moving member is formed by two independent halves 1*c* joined together by a connector 50, which can be a thermal connector for thermally isolating the two halves.

Figure 2D:
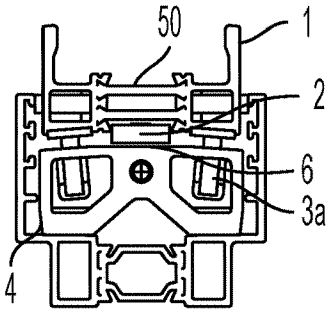
FIGS. 2A and 2B illustrate a roller centering device according to another exemplary embodiment and FIGS. 2C and 2D illustrate a modification thereof.
Figure 2C:
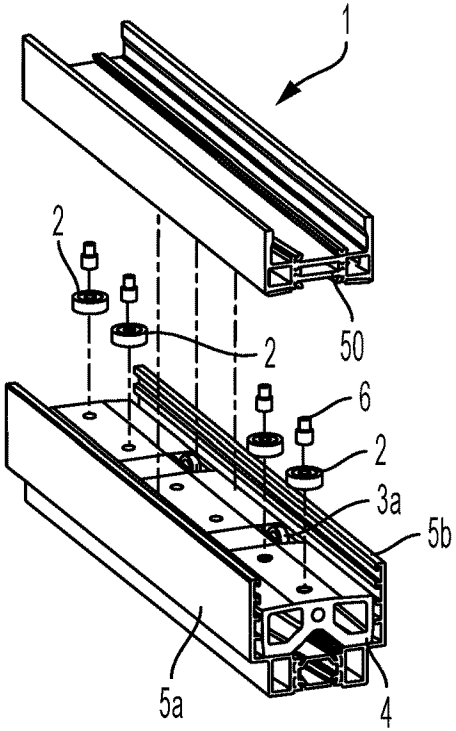
Figure 2B:
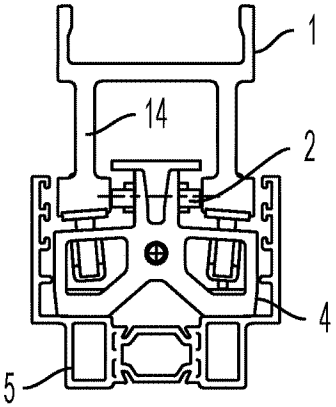
Figure 2A:
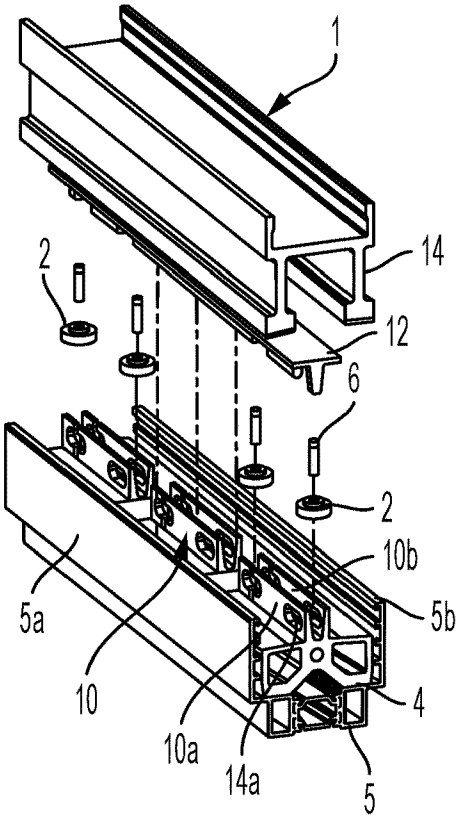

According to another embodiment, the centering rollers are centrally located in the rail 4. With reference to FIGS. 1A and 1B, the rail 4 includes a central cavity 10 defined by a pair of sides 10*a* and 10*b* that protrude from a surface of the rail 4 in the center portion thereof. The centering rollers 2 are provided in slots 14*a* extending through the respective sides 10*a*, 10*b*. The centering rollers 2 are rotatably fixed to the rail 4 by a fixing member 6 extending through a central hole of the centering roller 2*s* and into the sides 10*a* and 10*b*. The centering rollers contact the inner surface of the wings extending from the moving member 1 to center the moving member with respect to the rail 4, as best shown in FIG. 1B. As shown in FIG. 2A, the rollers may be disposed in the slots alternately provided in sides 10*a* and 10*b* along the length of the rail 4. In some embodiments, including the one shown in FIGS. 2A and 2B, the central cavity 10 includes a cover 12 that is disposed between the pair of sides 10*a*, 10*b* of the central cavity and contacts the fixing member 6. FIGS. 2C and 2D also show another embodiment in which the fixing members 6, including the centering rollers 2, protrudes directly from a center of the rail 4. The moving member 1 contacts the centering rollers 2 and maintains a centering movement of the moving member 1, and the door or window, when the door or window is moved.

Figure 3D:
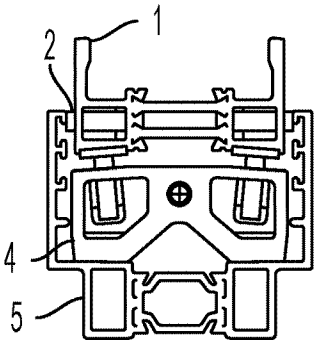
FIGS. 3A and 3B illustrate a roller centering device according to another exemplary embodiment and FIGS. 3C and 3D illustrate a modification thereof.
Figure 3C:
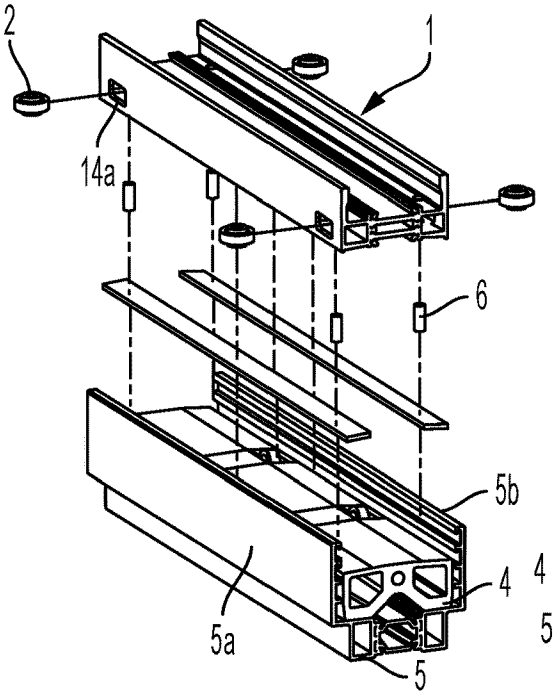
Figure 3B:
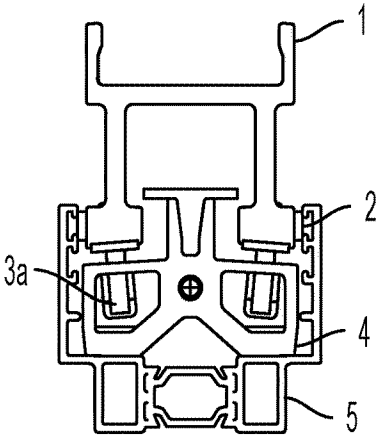
Figure 3A:
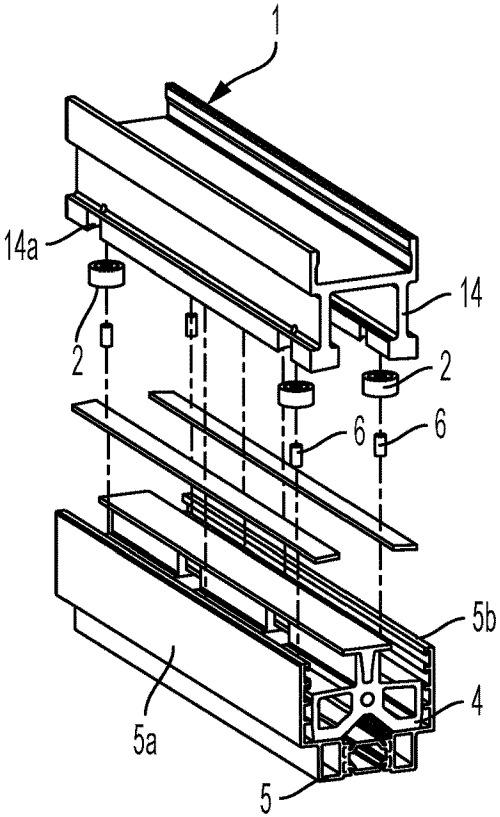

According to yet another exemplary embodiment, FIGS. 3A and 3B illustrate the centering rollers 2 provided on the moving member 1, instead of on the rail 4. Specifically, the centering rollers 2 are provided in slots formed in the wings 14 and fixed therein by fixing members 6. It will be understood that the wings 14 may be provided without slots 14*a*, as discussed below. FIGS. 3C and 3D also illustrates slots 14*a* provided on the right and left sides of the body of the moving member 1, without the inclusion of wings 14. The centering rollers 2 are provided in the slots and are rotatably fixed to the moving member 1 by the fixing members 6. As described above, the centering rollers 2 ensure that the moving member 1 maintains a center alignment in the door or window frame 5.

Figure 4B:
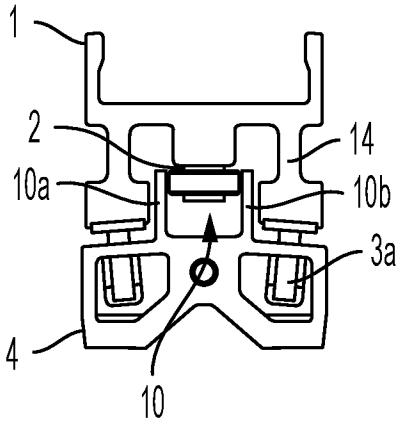
FIGS. 4A and 4B illustrate a roller centering device according to another exemplary embodiment.
Figure 4A:
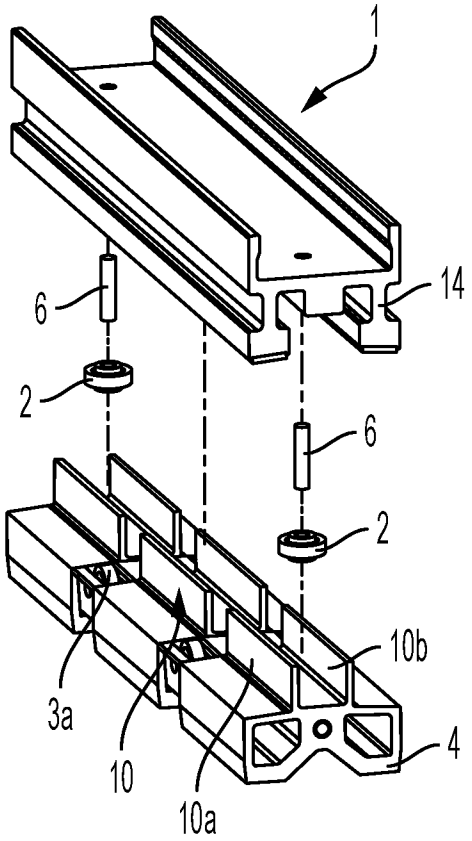

As shown in another exemplary embodiment, the wings 14 are not provided with slots. Instead, as shown in FIGS. 4A and 4B, the centering rollers 2 may be rotatably fixed to a central portion of the moving member 1 by the fixing members 6. When the rail 4 and the moving member 1 are assembled, the centering roller 2 is disposed in the central cavity 10 and is configured to contact the sides 10*a*, 10*b* to keep the moving member 1 centered. It is noted that this embodiment would also include a frame 5, as per the prior embodiments.

Figure 5B:
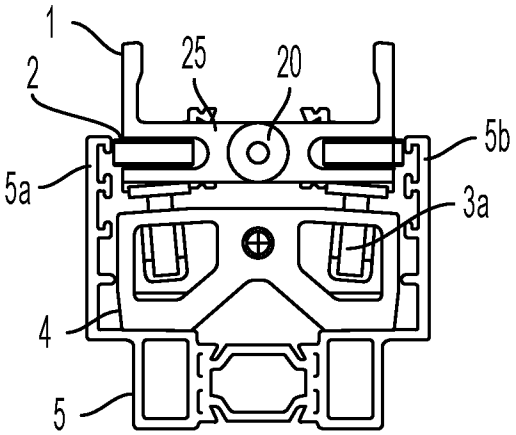
FIGS. 5A and 5B illustrate a roller centering device according to another exemplary embodiment.
Figure 5A:
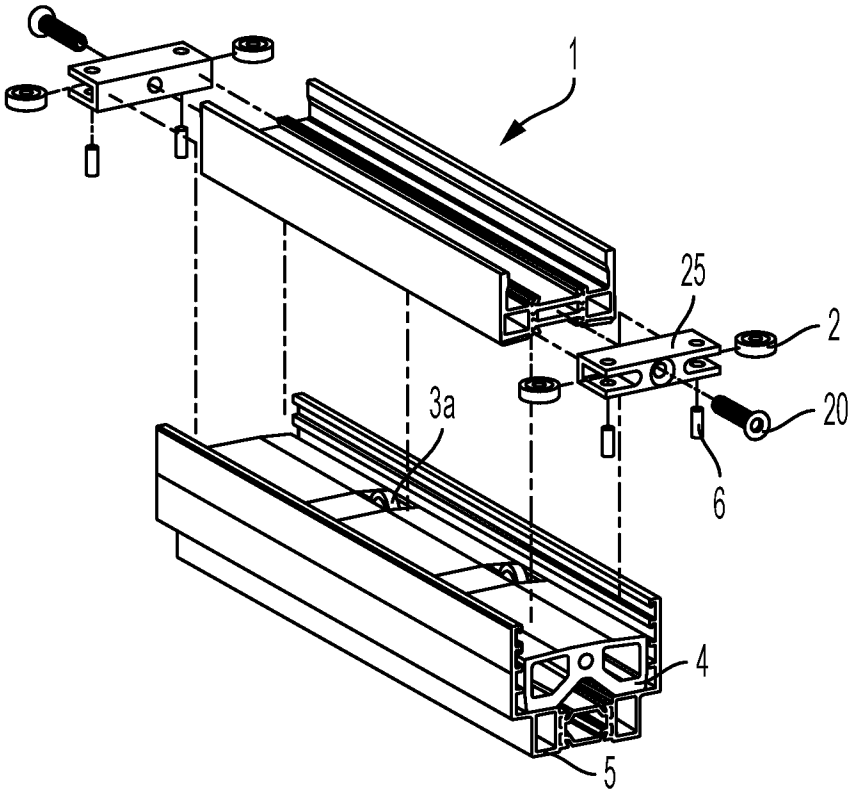

As shown in yet another exemplary embodiment, FIGS. 5A and 5B illustrate the centering rollers 2 provided on an auxiliary member 25 and the auxiliary member 25 is attached to the moving member 1 by a bolt 20, or any other means known in the art. When the moving member 1 and the frame 5 are assembled, FIG. 5B shows the centering rollers 2 horizontally disposed and contacting side walls 5*a*, 5*b* of the frame 5 to maintain a centering of the moving member 1. However, it will be understood that the centering rollers 2 are not restricted to a horizontal orientation.

Figure 6B:
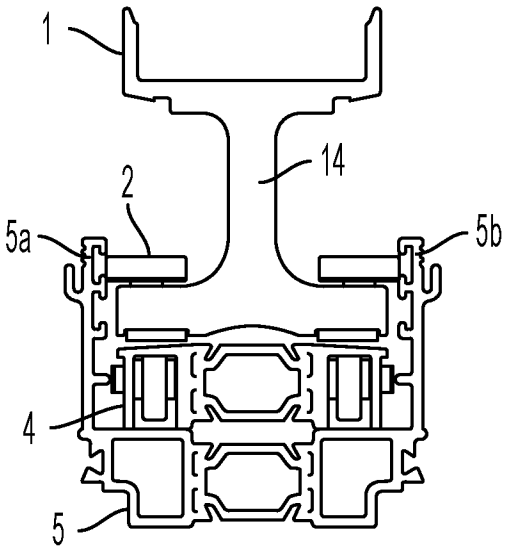
FIGS. 6A and 6B illustrate a roller centering device according to another exemplary embodiment.
Figure 6A:
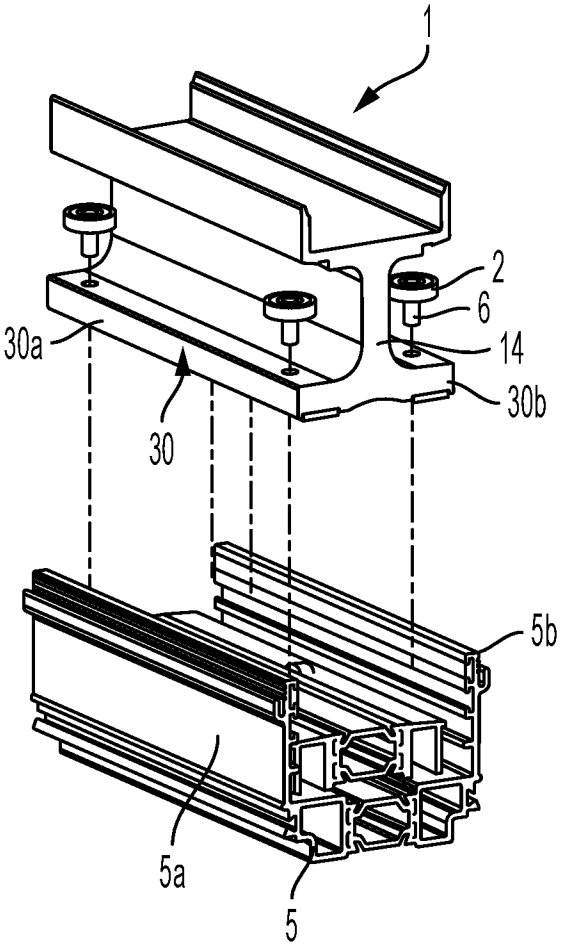

As shown in another exemplary embodiment, FIGS. 6A and 6B illustrate a moving member 1 provided with a single wing 14. A bottom end of the wing 14 is connected to or includes a base plate 30 that extends to either side of the wing 14. The centering rollers 2 may be rotatably fixed to a top surface of the left and rights sides 30*a*, 30*b* of the base plate 30 by the fixing members 6. It will be understood that the centering rollers 2 may be provided on a bottom surface of the base plate 30. When the moving member 1 and the frame 5 are assembled, FIG. 6B shows the centering rollers 2 horizontally disposed and contacting side walls 5*a*, 5*b* of the frame 5 to maintain a centering of the moving member 1. However, it will be understood that the centering rollers 2 are not restricted to a horizontal orientation.

As noted above, the roller centering device may be provided in the sill of the door or window (lower track), in the header (upper track), or in the jamb (side track) of the door or window, or in any combination of the sill, header, and jamb if so desired.

Figure 7B:
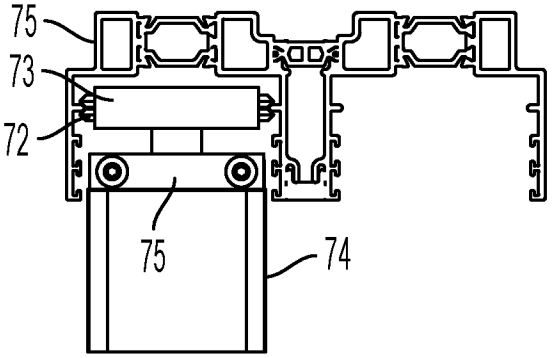
FIGS. 7A and 7B illustrate a roller centering device according to another exemplary embodiment.
Figure 7A:
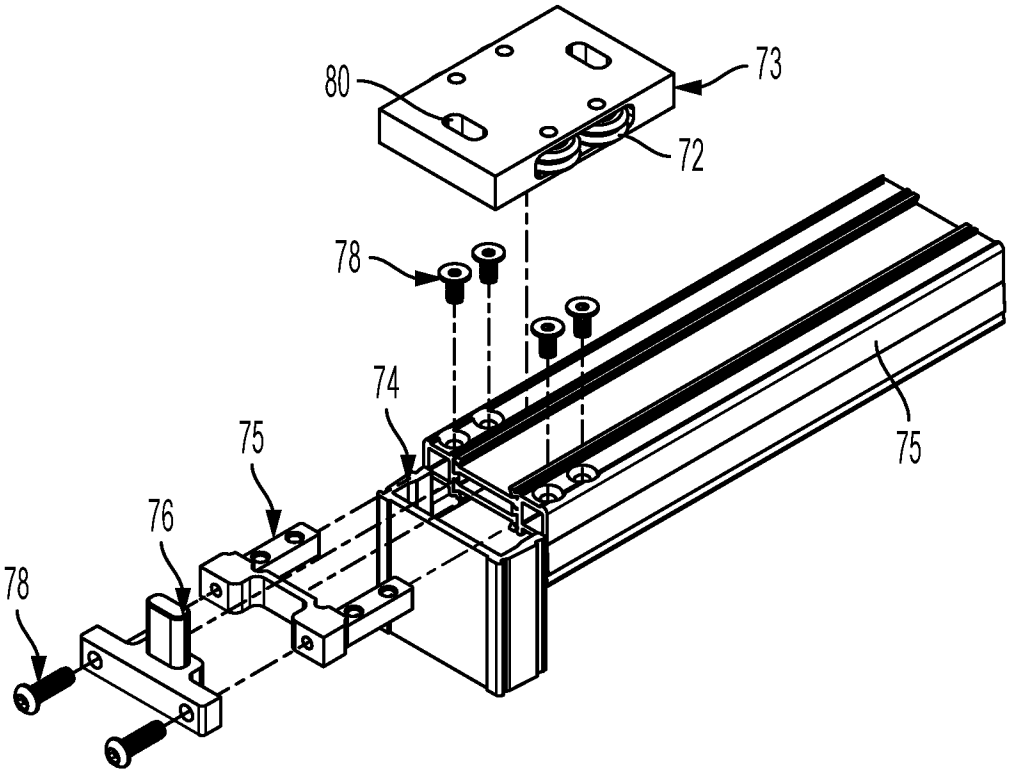

FIGS. 7A and 7B illustrate an exemplary embodiment of the roller centering device provided in the header or jamb. Provided is a header frame 75 that extends horizontally along the top of the window or door. Also shown is a jamb frame 74 extending vertically. The roller centering device includes a bearing retaining device 73 that retains bearings 72 on opposite sides thereof. In the illustrated embodiment there are four bearings, two on each side of the retaining device 73. The bearing retaining device 73 is slidably provided inside the header frame 75 and secured to the door or window using fixation connectors 75 and 76 using screws 78. That is, end connector 76 is secured to connector 75 by, e.g., two screws, which in turn is connected to the bearing retaining device 73 by, e.g., four screws. The end connector 76 includes a post 78 that is received in opening 80 provided in the bearing retaining device 73. According to this exemplary embodiment, the bearings 72 function to center the door or window along the headers to ensure smooth sliding thereof in the horizontal direction. This design can be similarly implemented in the jamb frame 74 as an additional centering feature or an alternative centering feature.

What is claimed is:

1. A centering device for centering a sliding door or a window, comprising:

a frame including a pair of sidewalls;

a rail provided in the frame, and that houses first centering rollers for movably supporting a vertical load of the sliding door or the window;

a moving member including downwardly extending wings having bottom surfaces that contact the first centering rollers and inner surfaces that contact a plurality of second centering rollers, wherein the moving member is configured to be movable within the frame and in a moving direction along the first centering rollers and the plurality of second centering rollers; and the plurality of second centering rollers abutting against the moving member to laterally center the moving member with respect to the frame, and the plurality of second centering rollers being configured to rotate about a vertical axis substantially perpendicular to the moving direction of the moving member, wherein the rail comprises a central cavity covered by a cover between the rail and the moving member and comprising both a pair of sides, extended upwards from the rail and into a cavity formed between the downwardly extended wings of the moving member, and a plurality of slots, in the pair of sides, into which ones of the second centering rollers are inserted and extended therethrough in a manner in which the second centering rollers are both partly held within the central cavity and partly protruded from the central cavity and into contact with inner surfaces of the downwardly extending wings of the moving member.

2. The centering device of claim 1, wherein the plurality of second centering rollers are provided in a central portion of the rail.

3. The centering device according to claim 1, wherein the rail includes a pair of opposing walls extending therefrom and the plurality of second centering rollers are rotatably fixed to the walls, respectively.

4. The centering device of claim 1, wherein the second centering rollers are fixed to the rail by a plurality of fixing members that are protruded through ones of the second centering rollers and directly from the rail.

* * * * *